US010207836B2

(12) United States Patent
Weathers et al.

(10) Patent No.: US 10,207,836 B2
(45) Date of Patent: Feb. 19, 2019

(54) FOLDABLE BAG SUPPORT SLEEVE

(71) Applicants: Larry V. Weathers, North Charleston, SC (US); Linda H. Weathers, North Charleston, SC (US)

(72) Inventors: Larry V. Weathers, North Charleston, SC (US); Linda H. Weathers, North Charleston, SC (US)

( * ) Notice: Subject to any disclaimer, the term of this patent is extended or adjusted under 35 U.S.C. 154(b) by 62 days.

(21) Appl. No.: 15/498,021

(22) Filed: Apr. 26, 2017

(65) Prior Publication Data

US 2017/0313508 A1 Nov. 2, 2017

Related U.S. Application Data

(60) Provisional application No. 62/329,235, filed on Apr. 29, 2016.

(51) Int. Cl.

| | |
|---|---|
| ***B65B 67/12*** | (2006.01) |
| ***B65F 1/14*** | (2006.01) |
| ***B65F 1/00*** | (2006.01) |
| *B65F 1/08* | (2006.01) |
| *B65F 1/06* | (2006.01) |

(52) U.S. Cl.

CPC ..... *B65B 67/1238* (2013.01); *B65B 67/1205* (2013.01); *B65B 67/1233* (2013.01); *B65F 1/0006* (2013.01); *B65F 1/1415* (2013.01); *B65F 1/06* (2013.01); *B65F 1/08* (2013.01); *B65F 2001/1489* (2013.01); *B65F 2240/138* (2013.01); *B65F 2250/105* (2013.01)

(58) Field of Classification Search

CPC ..... B65B 67/1238; B65B 67/1205; B65F 1/1415; B65F 1/06; B65F 1/08

USPC ..... 248/95, 97, 99, 152, 174; 141/390

See application file for complete search history.

(56) References Cited

U.S. PATENT DOCUMENTS

| | | | | | |
|---|---|---|---|---|---|
| 4,037,778 | A * | 7/1977 | Boyle | B65B 67/1238 | 141/390 |
| 4,115,909 | A * | 9/1978 | Corella | B65D 33/02 | 138/128 |
| 4,890,652 | A * | 1/1990 | Hoerner | B65B 67/1238 | 141/10 |
| 4,979,547 | A * | 12/1990 | Hoerner | B65B 67/1238 | 141/10 |
| 5,050,775 | A * | 9/1991 | Marquardt | B65D 77/065 | 222/105 |
| 5,129,609 | A * | 7/1992 | Tobin | B65B 67/1205 | 141/316 |
| 5,271,589 | A * | 12/1993 | Belous | B65B 67/1238 | 248/97 |

(Continued)

*Primary Examiner* — Eret C McNichols

(74) *Attorney, Agent, or Firm* — Jeffrey T. Stover; Haynsworth Sinkler Boyd, P.A.

(57) ABSTRACT

A foldable support sleeve that is deployable inside of a waste bag to support the waste bag includes a first side foldably connected to a second side, the second side foldably connected to a third side, the third side foldably connected to a fourth side, and the fourth side foldably connected to a fifth side. The foldable support sleeve may be foldable into a pre-deployed state and into a deployed state. The pre-deployed state may be associated with a first cross section that is smaller than a second cross section associated with the deployed state. The second cross section may be approximately equal to a cross section associated with the waste bag. The fifth side may help retain the foldable support sleeve in the deployed state.

15 Claims, 4 Drawing Sheets

(56) References Cited

U.S. PATENT DOCUMENTS

| | | | | | |
|---|---|---|---|---|---|
| 5,897,084 | A * | 4/1999 | Judge | B65B 67/1205 | 141/390 |
| 6,007,030 | A * | 12/1999 | Judge | B65B 67/1205 | 141/390 |
| 6,202,718 | B1 * | 3/2001 | Innocenti | B65D 71/30 | 141/391 |
| 6,367,747 | B1 * | 4/2002 | Mulle | B65D 33/007 | 248/97 |
| 6,536,488 | B1 * | 3/2003 | Pochobradsky | B65B 67/1238 | 141/390 |
| 6,708,742 | B2 | 3/2004 | Weathers et al. | | |
| 6,866,070 | B2 * | 3/2005 | King | B65F 1/1415 | 141/10 |
| D513,352 | S | 12/2005 | Weathers et al. | | |
| D633,268 | S * | 2/2011 | Bottita | D34/6 | |
| 8,757,563 | B2 * | 6/2014 | Muse | B65B 39/007 | 248/97 |
| 8,840,072 | B2 * | 9/2014 | Muse | B65B 67/1205 | 248/95 |
| 9,056,715 | B2 * | 6/2015 | Muse | B65F 1/06 | |
| 9,102,432 | B2 * | 8/2015 | Muse | B65B 67/1205 | |
| 2004/0026578 | A1 * | 2/2004 | King | B65B 67/1205 | 248/95 |
| 2007/0205255 | A1 * | 9/2007 | Dunn | B65D 71/36 | 229/117.13 |
| 2008/0023595 | A1 * | 1/2008 | Armaly, Jr. | B65B 67/12 | 248/97 |
| 2010/0243650 | A1 * | 9/2010 | Manley | B65B 67/1205 | 220/9.4 |
| 2011/0233091 | A1 * | 9/2011 | Block | B65D 5/0227 | 206/427 |
| 2015/0232222 | A1 * | 8/2015 | Muse | B65B 67/1238 | 248/97 |

* cited by examiner (SECTION A-A)

(SECTION A-A)

FOLDABLE BAG SUPPORT SLEEVE

REFERENCE TO RELATED APPLICATION

This application claims priority to U.S. Provisional Patent Application No. 62/329,235 filed on Apr. 29, 2016, the entire contents of the provisional application being incorporated herein by reference.

BACKGROUND

Waste bags (e.g. paper lawn bags, plastic trash bags, plastic liners, etc.) are typically not rigid and, as a result, collapse when the user attempts to fill them unless they are supported, such as by a trashcan. When a waste bag is not supported, users are usually required to fill the bag with care, such as by holding the waste bag up and/or open, to prevent the waste bag from collapsing and/or closing. For example, when a user of a paper lawn bag wishes to fill the bag with lawn waste (e.g. leaves, branches, twigs, etc.), the user may begin filling the paper lawn bag by hand or otherwise carefully placing small quantities of lawn waste into the bag to avoid deforming/closing the paper lawn bag until the volume of waste within the paper lawn bag holds the paper lawn bag open, which is not desirable.

To currently address the difficulty of filling waste bags, users may purchase external wire frames, trashcans made to fit a particular size bag, conventional leaf chutes, or some other type of support mechanism. However, these devices have their drawbacks. Some, like trashcans, do not work well with paper bags because paper bags are not flexible and, as a result, tend to rip when deployed in a trashcan. Others, like conventional leaf chutes, may collapse when they are used and can be difficult to deploy into the bag. What is needed is a device that works well with bags made of a variety of different materials, that limits and/or prevents the bag from collapsing when the device is deployed, and that is easily deployed for use within a bag.

SUMMARY

According to an embodiment described herein, a foldable support sleeve that may be deployed inside of a waste bag to support the waste bag may include a first side foldably connected to a second side. The second side may be foldably connected to a third side. The third side may be foldably connected to a fourth side. The fourth side may be foldably connected to a fifth side. The foldable support sleeve may be foldable into a pre-deployed state, which may define a first cross section. Additionally, or alternatively, the foldable support sleeve may be foldable into a deployed state, which may define a second cross section. The first cross section may be smaller than the second cross section. The second cross section may be approximately equal to a cross section associated with the waste bag. The fifth side of the foldable support sleeve may limit and/or prevent the foldable support sleeve from unfolding when the foldable support sleeve is in the deployed state inside of the waste bag. The first side of the foldable support sleeve may define a first width. The second side of the foldable support sleeve may define a second width. The fifth side of the foldable support sleeve may define a third width. The third width may be less than at least one of the second width or the first width. The foldable support sleeve may include handles, stops and/or clips.

A method for supporting a waste bag, described herein, may include providing a foldable support sleeve having at least four sides. One of the four sides may be a retaining side. Each of the sides may be foldably connected to at least one other side. The method may further include providing a waste bag. The method may further include folding the foldable support sleeve into a pre-deployed state. The pre-deployed state may define a first cross section. The method may further include placing the foldable support sleeve into the waste bag when the foldable support sleeve is in the pre-deployed state. The method may further include folding the foldable support sleeve into a deployed state, the deployed state may define a second cross section that is larger than the first cross section. The second cross section may be similar in size to a third cross section associated with an opening in the waste bag. The retaining side may limit and/or prevent the foldable support sleeve from becoming unfolded. The method may further include connecting the foldable support sleeve to the waste bag using clips and/or stops.

According to another embodiment described herein, a five-sided support sleeve that may be deployable inside of a paper lawn bag to support the paper lawn bag may include a first side that defines an edge and is foldably connected to a second side The second side may be foldably connected to a third side The third side may be foldably connected to a fourth side The fourth side may be foldably connected to a fifth side. The five-sided support sleeve may further include a first seam located between the fourth side and the fifth side. The five-sided support sleeve may further include a second seam located between the third side and the fourth side. The five-sided support sleeve may be foldable into a pre-deployed state in which the edge is located proximate the second seam. The pre-deployed state may define a first cross section. The five-sided support sleeve may be foldable into a deployed state in which the edge is located proximate the first seam. The deployed state may define a second cross section, and the first cross section may be smaller than the second cross section. The second cross section being approximately equal to a cross section associated with the paper lawn bag. The fifth side of the five-sided support sleeve may limit and/or prevents the five-sided support sleeve from unfolding when the five-sided support sleeve is in the deployed state inside of the paper lawn bag. The first side of the five-sided support sleeve may defines a first width. The fourth side may defines a second width. The fifth side may defines a third width. The third width may be less than at least one of the second width or the first width. The five-sided support sleeve may further include handles, stops and/or clips.

DETAILED DESCRIPTION

Figure 1:
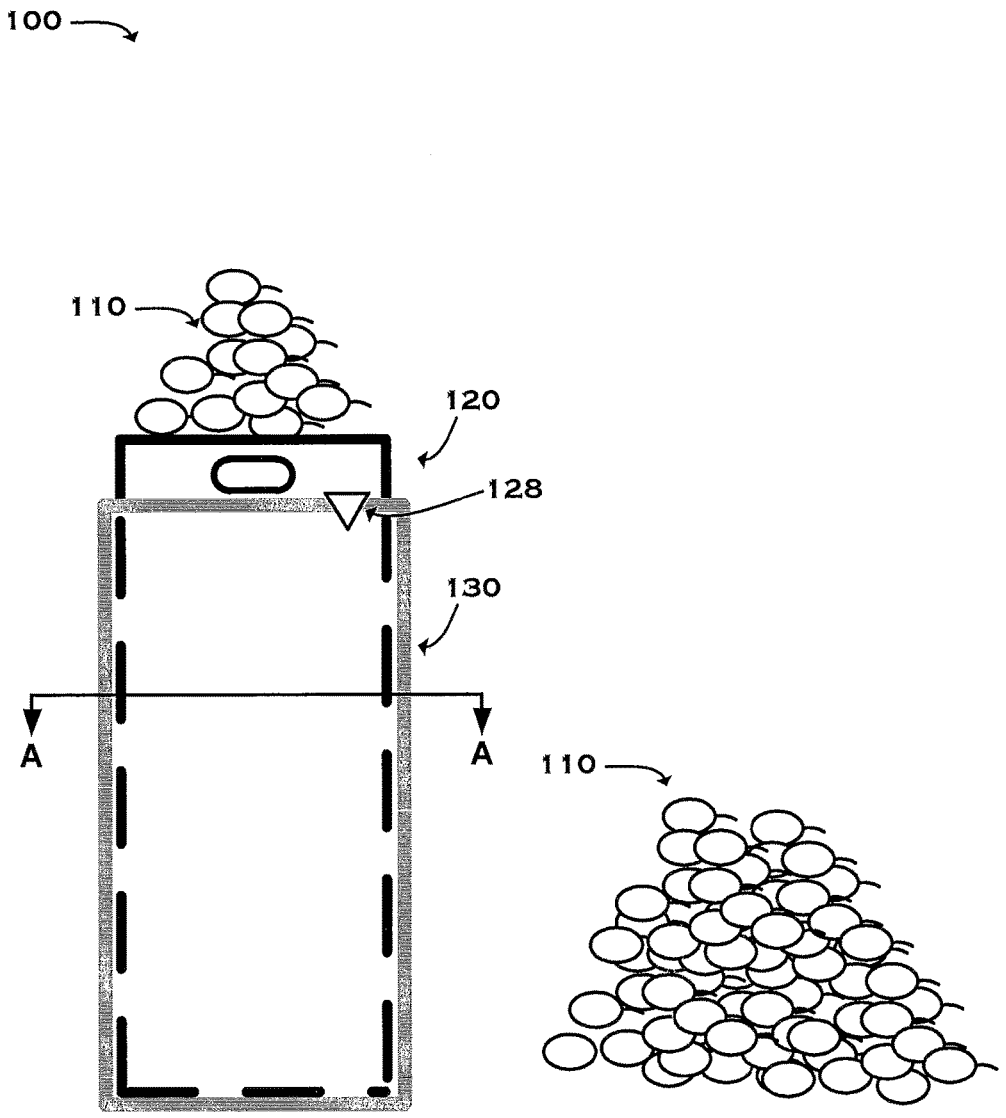
FIG. 1 illustrates a non-limiting example environment in which the apparatus, system, method and/or technology, described herein, may be implemented.

FIGS. 1 through 4 are attached hereto and incorporated by reference herein. The following detailed description refers to the accompanying FIGS. 1 through 4. The same reference numbers in the different figures may identify the same or similar elements. The components illustrated in FIGS. 1 through 4 are provided for explanatory purposes only, and the disclosure herein is not intended to be limited to the components provided therein. There may be additional components, fewer components, different components, or differently arranged components than illustrated in FIGS. 1 through 4. Also, in some implementations, one or more of the components of the foldable bag support sleeve may perform one or more functions described as being performed by another one or more of the components of the foldable bag support sleeve.

An apparatus, method and/or technology, as described herein, may include a foldable bag support sleeve (hereinafter "support sleeve") that supports a variety of different bags (e.g., lawn waste bags, trash bags, etc.) made of a variety of materials (e.g. paper, plastic, biodegradable materials, compostable materials, etc.). For example, the support sleeve may support a lawn bag which a user wishes to fill with lawn waste (e.g. leaves, twigs, mulch, etc.) in a way that prevents the bag from collapsing and/or closing when the user attempts to fill the bag with lawn waste. The support sleeve may support a lawn bag when the support sleeve is deployed within the lawn bag as described herein. Additionally, or alternatively, when a lawn bag is full of lawn waste (e.g., leaves, twigs, mulch, etc.), the support sleeve may be removed (e.g. slid out by pulling it up and out of the lawn bag, etc.) once any clips and/or stops have been disengaged from the lawn bag. The support sleeve may be stored and used again, and the bag may be discarded.

To deploy the support sleeve in a lawn bag, the support sleeve may be folded into a pre-deployed state to insert the support sleeve into the bag. When in the pre-deployed state, the support sleeve may have a cross section that is smaller than the cross section of the bag when the bag is opened, which may facilitate inserting the support sleeve into the bag. The support sleeve may be folded into a deployed state to support the bag when the user wishes to fill the bag. The cross section of the support sleeve in the deployed state may be approximately equal to the cross section of the bag (e.g. the cross sectional area of the opening in the bag, the cross section of a fully opened dimension within the bag, etc.) the when the bag is fully opened and may allow a user to place debris (e.g. lawn debris, etc.) into the lawn bag. The cross section of the support sleeve in the deployed state is larger than the cross section of the support sleeve when the support sleeve is in the pre-deployed state. The support sleeve may be folded from the pre-deployed to the deployed state when the support sleeve is inside of the bag. A user may connect the support sleeve to the bag and/or to a funnel to be used with the support sleeve, such as by using one or more clips or stops.

The support sleeve may include support sides, which define the shape and/or size of the support sleeve when the support sleeve is in the deployed state, and one or more retaining sides, which may limit and/or prevent the support sleeve from unfolding from the deployed state. The support sleeve may include a wide variety of pre-deployed and deployed cross sections (e.g. triangle, square, rectangle, pentagon, etc.) and/or sizes (e.g. 5 gallon, 30 gallon, 100 gallon, etc.) to accommodate the needs of different users who wish to store different types of waste and/or other items in different quantities within different bags.

The embodiments, described herein, correspond to a support sleeve used for lawn-waste bags for explanatory purposes. Additionally, or alternatively, the support sleeve may be used to in connection with other types of bags in addition to or instead of lawn-waste bags. In a non-limiting example, a user may use the foldable bag support sleeve to support a kitchen trash bag, industrial liner, etc. The term "cross section," when used herein, refers to the size/cross sectional area of the object to which it refers. For example, the cross section of a standard 30 gallon lawn bag, such at that depicted in FIG. 1, is 192 square inches as a result of having a 16 ×12 inch opening.

FIG. 1 illustrates a non-limiting example environment in which the apparatus, method and/or technology, described herein, may be implemented. For example, the environment 100 may include lawn waste 110 (e.g. leaves, twigs, mulch, etc.), a lawn bag 130 (e.g. a 10, 20, 30, 50 gallon paper bag, plastic bag, etc.), and a foldable bag support sleeve 120 (hereinafter "support sleeve 120"). Support sleeve 120 is described in greater detail in FIGS. 2 through 4B and may include one or more components associated with supporting lawn bag 130 while the user fills lawn bag 130. In a non-limiting example, support sleeve 120 may enable the user to fill lawn bag 130 with lawn waste 110. Once lawn bag 130 is full of lawn waste 110, the user may remove support sleeve 120 from lawn bag 130. Support sleeve 120 may include one or more stops 128, which may connect support sleeve to lawn bag 130 and/or a funnel, as may be further discussed in reference to FIG. 2.

Support sleeve 120 may be formed from a material (e.g., a metal alloy, composite, plastics, wood, fiberglass, cardboard, biodegradable materials, compostable materials, etc.) of sufficient strength and rigidity to support the static and/or dynamic loads (e.g., forces, torques, tensions, compressions, stresses, strains, etc.) imparted on support sleeve 120 by the user (e.g., when folding support sleeve 120 into the pre-deployed state, when inserting support sleeve 120 into lawn bag 130, when deploying support sleeve 120, when removing support sleeve 120 from lawn bag 130, when placing lawn waste 110 into lawn bag 130 inside of which support sleeve 120 is located, etc.), lawn bag 130 and/or lawn waste 110. Support sleeve 120 may also, or alternatively, be formed from a material (e.g., stainless steel, composite, plastics, ceramic, fiberglass, etc.) of sufficient corrosion resistance and toughness to withstand exposure to water, solvents, sunlight, and various types of waste. Support sleeve 120 may be composed of one piece of material that may be folded and/or have live hinges. Additionally, or alternatively, support sleeve may be formed from more than one piece of material. The types and shapes of support sleeve 120 are not intended to be limited to those shown in FIGS. 1 through 4B.

Figure 2:
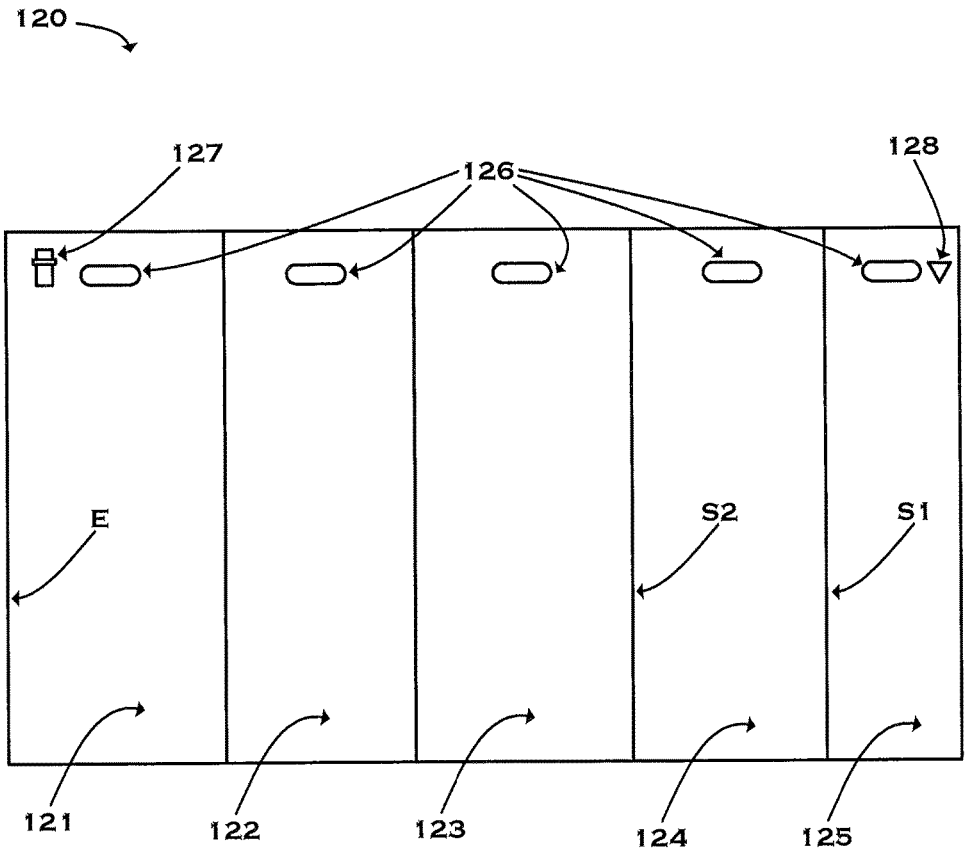
FIG. 2 illustrates a non-limiting example embodiment of a foldable bag support sleeve.

FIG. 2 illustrates a non-limiting example embodiment of a support sleeve 120. As shown in FIG. 2, support sleeve 120 may include a first side 121, a second side 122, a third side 123, a fourth side 124, a fifth side 125, handles 126, one or more clips 127 and/or one or more stops 128. The components illustrated in FIG. 2 are provided for explanatory purposes only, and the disclosures herein are not intended to be limited to the components reflected in the drawings. There may be additional components, fewer components, different components, or differently arranged components than illustrated in FIG. 2. For instance, although support sleeve 120 depicted in FIG. 2 has five sides, support sleeve 120 may have more or less than five sides. Also, in some implementations, one or more components of support sleeve 120 may perform one or more functions described as being performed by another one or more of the components of support sleeve 120.

Support sleeve 120 may be foldable between each of sides 121-125, such as to assist the user in using support sleeve 120. The sides 121-125 may define the size (e.g. height, width, cross section when deployed and/or pre-deployed, etc.) of the support sleeve 120. Each of sides 121-125 may be a different width and/or height. Additionally, or alternatively, one or more of sides 121-125 may have the same height and/or width. First side 121 may be foldably connected (e.g. a seam in material, one or more hinges, etc.) to second side 122. Second side 122 may be foldably connected to third side 123. Third side 123 may be foldably connected to fourth side 124. Fourth side 124 may be foldably connected to fifth side 125. Fifth side 125 may serve as a retaining side, as discussed below in connection with FIG. 3B, and may have a width that is smaller than the width of first side 121.

Figure 3A:
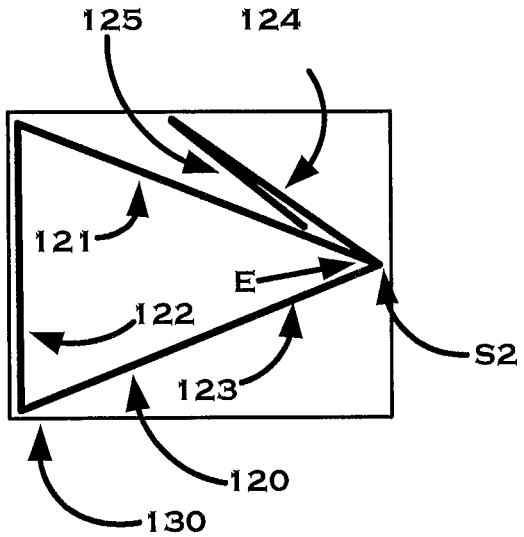
FIGS. 3A & 3B illustrate a non-limiting example embodiment of a foldable bag support sleeve within a waste bag of rectangular cross section.
Figure 3B:
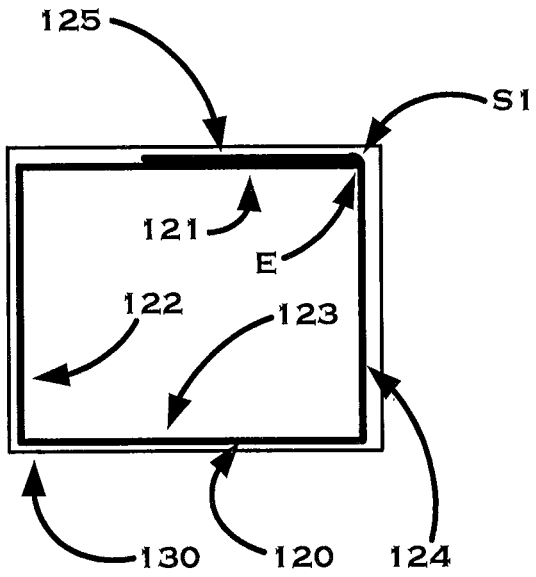

When support sleeve 120 is placed in the deployed state, first side 121, second side 122, third side 123 and/or fourth side 124 may be folded (e.g. at approximately 90 degrees angles as depicted in FIG. 3B, at other angles, etc.) to define the cross section and/or shape of support sleeve 120. Because support sleeve 120 is generally rectangular when deployed, each of the sides 121-125 are generally 90 degrees from the side to which a particular side is connected when support sleeve is deployed. Support sleeves that have a different cross section (e.g. triangular, pentagon, etc.) from support sleeve 120 may have different angles between the sides when other support sleeves are deployed.

First side 121 may define an edge E. When support sleeve 120 is deployed for use in lawn bag 130, edge E may be located proximate a first seam S1 that is located and/or formed between fourth side 124 and fifth side 125. Further, when support sleeve 120 is deployed, fifth side 125 may make contact with and/or be adjacent to first side 121, which may maintain support sleeve 120 in the deployed state by causing edge E of first side 121 to make contact with and/or be located proximate first seam S1. By causing edge E of first side 121 to make contact with and/or be located proximate first seam S1, fifth side 125 may limit and/or prevent support sleeve 120 from unfolding out of the deployed state and/or retain support sleeve 120 in the deployed state. When deployed in a bag having an approximately equal cross section as the support sleeve 120 in the deployed state, the bag may maintain fifth side 125 in close proximity to first side 121, which may limit and/or prevent support sleeve 120 from leaving the deployed state.

Support sleeve 120 may also be pre-deployed to assist the user in inserting support sleeve 120 into lawn bag 130. When support sleeve 120 is placed in the pre-deployed state, support sleeve 120 may define a smaller cross section than the cross section of support sleeve 120 when support sleeve 120 is placed in the deployed state. Therefore, pre-deployed support sleeve 120 may be easier to insert into lawn bag 130 than deployed support sleeve 120. When support sleeve 120 is in the pre-deployed state, edge E of first side 121 may make contact with or be located proximate a second seam S2, that is located and/or formed between third side 123 and fourth side 124, as depicted in FIG. 3A.

Support sleeve 120 may include one or more handles 126. The user may use handles 126 when inserting support sleeve 120 into lawn bag 130, removing bag support sleeve 120 from lawn bag 130, or carrying support sleeve 120. As depicted in FIG. 2, handles 126 may reside within first side 121, second side 122, third side 123, fourth side 124 and/or fifth side 125. As depicted in FIG. 2, handles 126 may reside within some or all of sides 121-125 of support sleeve 120. Additionally, or alternatively, handles 126 may be connected to (i.e. screws, rivets, adhesives, welding, etc.) one or more sides 121-125 of support sleeve 120 and may be located above, below, inside, or in the vicinity of one or more of sides 121-125. Handles may be formed from the same material or different material from the material used to form sides 121-125 of support sleeve 120. Handles 126 depicted in FIG. 2 are for explanatory purposes only, and the disclosures herein are not intended to be limited to handles 126 reflected in the drawings.

Support sleeve 120 may include one or more clips 127 (e.g. alligator-style clips, binder clips, clothespin-style clips, spring clamps, desyne clips, valence clips, bankers clips, bulldog clips, etc.). Clips 127 may apply a clamping force to connect support sleeve 120 to a lawn bag, a funnel, and or other objects (e.g. gloves, a rake, etc.). Clips 127 may be located on any and/or all of the sides of support sleeve 120. Clips 127 may connect support sleeve 120 to a bag, such as to hold the bag in place while it is being filled. Additionally, or alternatively, a user may connect support sleeve 120 using clips 127 to hold a funnel in place while a user fills a bag. A funnel may be an object (e.g. that acts like a conventional funnel) that is used to direct debris into support sleeve 120, such as the lawn waste 110 depicted in FIG. 1. A funnel may be connected to support sleeve 120 opposite the lawn bag and may extend from support sleeve 120. A funnel may make increase the opening through which lawn waste 110 and/or other debris enters support sleeve 120, which may make it easier for a user to fill a lawn bag. A user may fill the lawn bag through the funnel while it is standing up, or may lay the support sleeve 120, lawn bag and/or funnel on the ground so that the debris may be slid up the funnel and into the lawn bag. Additionally, or alternatively, a user may scoop debris into the lawn bag by using the combination of the lawn bag support sleeve 120 and/or funnel to scoop debris into the lawn bag.

Support sleeve 120 may include one or more stops 128. Stops 128 may be made from a penetration, cut and/or slit through one or more of the sides of support sleeve 120 such that it is made from the same material as the side to which it is connected. Additionally, or alternatively, stops 128 may be connected to (i.e. screws, rivets, adhesives, welding, etc.) one or more sides and be made from a separate piece of material (e.g. cardboard, composite, plastics, metals, etc.). Stops 128 may provide a channel (e.g. a C-channel shape, etc.) that may connect (e.g. slip fit, press fit, etc.) support sleeve 120 to a bag and/or a funnel. While the stops 128 depicted in FIGS. 1 and 2 are rectangular, the types and shapes of stops are not intended to be limited to what is shown in FIG. 2. Stops 128 may be located on any and/or all of the sides of support sleeve 120. As depicted in FIG. 1, Stops 128 may connect support sleeve 120 to a bag, such as to hold the bag in place while it is being filled. Additionally, or alternatively, a user may connect support sleeve 120 using stops 128 to a funnel for the funnel to be used for the reasons described above with respect to clips 127. Additionally, or alternatively, support sleeve 120 may include one or more other means for connecting (e.g. hooks, apertures, loops, etc.) support sleeve 120 to a bag and/or funnel.

FIGS. 3A & 3B illustrate a non-limiting example embodiment of a support sleeve 120 within a lawn bag 130 having a generally rectangular cross section (e.g. such as a 30-gallon paper lawn bag). As depicted in FIG. 3A, the support sleeve 120 may be pre-deployed in the lawn bag 130. When support sleeve 120 is in a pre-deployed state, first side 121, second side 122 and third side 123 may define a triangular cross section when edge E of first side 121 makes contact with and/or is located proximate second seam S2. Second seam S2 may be located between third side 123 and fourth side 124. In this pre-deployed state, fourth side 124 and fifth side 125 may be located outside of this triangular cross section and may touch and/or be located proximate first side 121. When pre-deployed, support sleeve 120 may be easily inserted into lawn bag 130 because the cross section of support sleeve 120 is smaller than the opening and/or cross section of lawn bag 130.

As depicted in FIG. 3B, support sleeve 120 may be deployed in lawn bag 130 to enable the user to fill lawn bag 130 with lawn waste without deforming lawn bag 130. When the support sleeve 120 is in the deployed state, the cross section of the support sleeve 120 may be approximately equal (i.e. within 5%, 10%, more preferably within less than 5%, etc.) to a cross section of the lawn bag 130, such as a cross section defined by an opening in the lawn bag 130. When support sleeve 120 is placed in the deployed state, the first side 121, second side 122, third side 123 and/or fourth side 124 may define a rectangular cross section when edge E of first side 121 makes contact with and/or is located proximate first seam S1. First seam S1 may be located between fourth side 124 and fifth side 125. When support sleeve 120 is in the deployed state within lawn bag 130, fifth side 125 may be located between lawn bag 130 and first side 121, and lawn bag 130 may cause fifth side 125 to maintain contact with and/or be located proximate first side 121, which may cause support sleeve 120 to remain deployed by causing edge E of first side 121 to maintain contact with and/or be located proximate first seam S1. As depicted in FIG. 3B, fifth side 125 may define a width that may be less than a width of the first side 121 and/or fourth side 124. As depicted in FIG. 3B, first side 121 defines the width of one edge of support sleeve 120 when in a deployed state, which would not occur if the width of fifth side 125 was greater than first side 121. Additionally, or alternatively, the width of fifth side 125 may be less than the width of first side 121 and/or fourth side 124 to allow support sleeve 120 to be placed in the deployed and/or pre-deployed position. For example, if the width of fifth side 125 exceeds the widths of first side 121 and/or fourth side 124, fifth side 125 may not fit between fourth side 124 and first side 121 as depicted in FIG. 3A, which may limit and/or prevent a user from placing support sleeve 120 in a pre-deployed state.

Figure 4A:
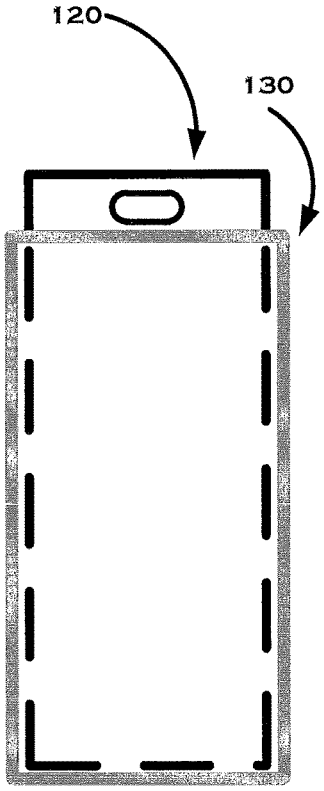
FIGS. 4A & 4B illustrate non-limiting example embodiments of the foldable bag support sleeve within a waste bag.
Figure 4B:
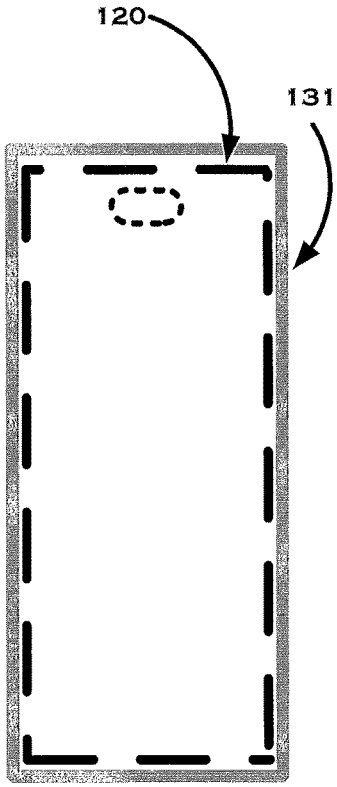

FIGS. 4A & 4B illustrate non-limiting example embodiments of support sleeve 120 within lawn bag 130. As depicted in FIG. 4A, support sleeve 120 may be inserted into lawn bag 130 that is shorter than support sleeve 120, which may cause a portion of support sleeve 120 to reside outside of lawn bag 130 when support sleeve 120 is fully inserted into lawn bag 130. Alternatively, as depicted in FIG. 4B, support sleeve 120 may be inserted into a lawn bag 131 that is taller than support sleeve 120, which may cause support sleeve 120 to reside completely within lawn bag 131 when fully inserted into lawn bag 131.

While preferred embodiments of the invention have been shown and described, those skilled in the art will recognize that other changes and modifications may be made to the foregoing embodiments without departing from the scope and spirit of the invention. For example, specific shapes of various elements of the illustrated embodiments may be altered to suit particular applications. Additionally, the foldable bag support sleeve may have more or less sides. Further, the embodiments disclosed herein may be used in different applications. For example, the embodiments disclosed herein may be used to support bags other than waste or lawn bags. It is intended to claim all such changes and modifications as fall within the scope of the disclosure herein and the equivalents.

The foregoing description provides illustration and description, but is not intended to be exhaustive or to limit the implementations to the precise form disclosed. Modifications and variations are possible in light of the above disclosure or may be acquired from practice of the embodiments.

It will be apparent that the apparatus, devices, methods, technologies and/or techniques, as described above, may be implemented in many different forms of hardware and/or materials in the implementations described herein and illustrated in the figures. The actual or specialized hardware and/or materials used to implement these the apparatus, devices, methods, technologies and/or techniques is not limiting of the embodiments—it being understood that hardware and/or materials can be designed to implement the apparatus, devices, methods, technologies and/or techniques based on the description herein.

It should be emphasized that the terms "comprises"/"comprising" when used in this specification are taken to specify the presence of stated features, integers, steps or components but does not preclude the presence or addition of one or more other features, integers, steps, components or groups thereof.

Even though particular combinations of features are recited in the claims and/or disclosed in the specification, these combinations are not intended to limit the disclosure of the embodiments. In fact, many of these features may be combined in ways not specifically recited in the claims and/or disclosed in the specification. Although each dependent claim listed below may directly depend on only one other claim, the disclosure of the embodiments includes each dependent claim in combination with every other claim in the claim set.

No element, act, or instruction used in the present application should be construed as critical or essential to the embodiments unless explicitly described as such. Also, as used herein, the article "a" and "an" are intended to include one or more items and may be used interchangeably with "one" or "more." Where only one item is intended, the term "one" or similar language is used. Further, the phrase "based on" is intended to mean "based, at least in part, on" unless explicitly stated otherwise.

What is claimed is:

1. A foldable support sleeve that is deployable inside of a waste bag to support the waste bag, the foldable support sleeve including:

a first side defining a first side width and being foldably connected to a second side;

the second side located between two adjacent, foldable seams and foldably connected to a third side;

the third side defining a third side width that is approximately equal to the first side width, the third side being foldably connected to a fourth side;

the fourth side located between two adjacent, foldable seams and foldably connected to a fifth side, the fifth side not adhered to the first side;

the foldable support sleeve being foldable into a pre-deployed state, the pre-deployed state defining a first cross section;

the foldable support sleeve being foldable into a deployed state, the deployed state defining a second cross section, the first cross section being smaller than the second cross section, the second cross section being approximately equal to a cross section associated with the waste bag;

wherein the fifth side limits and/or prevents the foldable support sleeve from unfolding when the foldable support sleeve is in the deployed state inside of the waste bag.

2. The foldable support sleeve of claim 1, where the fourth side defines a fourth side width and the fifth side defines a fifth side width, the fifth side width being less than at least one of the first side width or the fourth side width.

3. The foldable support sleeve of claim 1 further including handles.

4. The foldable support sleeve of claim 1 further including stops.

5. The foldable support sleeve of claim 1 further including clips.

6. A method for supporting a waste bag, the method including:

providing a foldable support sleeve having at least five sides, including:

a first side defining a first side width, the first side foldably connected to a second side;

the second side foldably connected to a third side;

the third side defining a third side width that is approximately equal to the first side width, the third side being foldably connected to a fourth side;

the fourth side foldably connected to a fifth side, the fifth side not adhered to the first side;

the second side, third side and fourth side each being located between two adjacent, foldable seams;

providing a waste bag;

folding the foldable support sleeve into a pre-deployed state, the pre-deployed state defining a first cross section;

placing the foldable support sleeve into the waste bag when the foldable support sleeve is in the pre-deployed state;

folding the foldable support sleeve into a deployed state, the deployed state defining a second cross section that is larger than the first cross section, the second cross section being similar in size to a third cross section associated with an opening in the waste bag, and the fifth side limiting and/or preventing the foldable support sleeve from becoming unfolded from the deployed state.

7. The method of claim 6 further including connecting the foldable support sleeve to the waste bag.

8. The method of claim 7, where the foldable support sleeve is connected to the waste bag using clips.

9. The method of claim 7, where the foldable support sleeve is connected to the waste bag using stops.

10. The method of claim 6 where the foldable support sleeve further includes a first seam located between a fourth side and the fifth side and a second seam located between a third side and the fourth side and where an edge of a first side is located proximate the second seam in the pre-deployed state and proximate the first seam in the deployed state.

11. A five-sided support sleeve that is deployable inside of a paper lawn bag to support the paper lawn bag, the five-sided support sleeve including:

a first side defining an edge and a first side width, the first side being foldably connected to a second side;

the second side located between two adjacent, foldable seams and foldably connected to a third side;

the third side defining a third side width that is approximately equal to the first side width, the third side foldably connected to a fourth side;

the fourth side foldably connected to a fifth side, the fifth side not adhered to the first side and not foldably connected to any sides other than the fourth side;

a first seam located between the fourth side and the fifth side;

a second seam located between the third side and the fourth side, the first seam and second seam being adjacent seams, and fourth side located between the first seam and second seam;

the five-sided support sleeve being foldable into a pre-deployed state in which the edge is located proximate the second seam, the pre-deployed state defining a first cross section;

the five-sided support sleeve being foldable into a deployed state in which the edge is located proximate the first seam, the deployed state defining a second cross section, the first cross section being smaller than the second cross section, the second cross section being approximately equal to a cross section associated with the paper lawn bag;

wherein the fifth side limits and/or prevents the five-sided support sleeve from unfolding when the five-sided support sleeve is in the deployed state inside of the paper lawn bag.

12. The five-sided support sleeve of claim 11, where the fourth side defines a fourth side width and the fifth side defines a fifth side width, the fifth side width being less than at least one of the fourth side width or the first side width.

13. The five-sided support sleeve of claim 11 further including handles.

14. The five-sided support sleeve of claim 11 further including stops.

15. The five-sided support sleeve of claim 11 further including clips.

* * * * *